US005701685A

United States Patent [19]

Pezza

[11] Patent Number: 5,701,685

[45] Date of Patent: Dec. 30, 1997

[54] TRIPLE-ACTION, ADJUSTABLE, REBOUND DEVICE

[75] Inventor: Mariner J. Pezza, 12 June Ave., Norwalk, Conn. 06850

[73] Assignee: Mariner J. Pezza, Norwalk, Conn.

[21] Appl. No.: 788,053

[22] Filed: Jan. 23, 1997

[51] Int. Cl.[6] ..... A43B 3/10; A43B 13/28

[52] U.S. Cl. ..... 36/7.8; 36/27

[58] Field of Search ..... 36/7.8, 27, 132, 36/136, 38, 25 R

[56] References Cited

U.S. PATENT DOCUMENTS

| | | | |
|---|---|---|---|
| 1,625,048 | 4/1927 | Nock | 36/38 |
| 2,953,861 | 9/1960 | Horten | 36/7.8 |
| 4,302,891 | 12/1981 | Gulu | 36/7.8 |
| 4,360,978 | 11/1982 | Simpkins | 36/7.8 X |
| 4,492,374 | 1/1985 | Lekhtman et al. | 36/7.8 X |
| 4,534,124 | 8/1985 | Schnell | 36/7.8 X |
| 4,592,153 | 6/1986 | Jacinto | 36/7.8 X |
| 4,660,299 | 4/1987 | Omiluslk | 36/7.8 |
| 4,707,934 | 11/1987 | Hart | 36/7.8 |
| 4,894,934 | 1/1990 | Illustrato | 36/38 X |
| 4,912,859 | 4/1990 | Ritts | 36/7.8 |
| 5,060,401 | 10/1991 | Whatley | 36/7.8 X |
| 5,282,325 | 2/1994 | Beyl | 36/38 X |
| 5,343,636 | 9/1994 | Sabol | 36/7.8 |
| 5,343,637 | 9/1994 | Schindler | 36/7.8 X |

FOREIGN PATENT DOCUMENTS

| | | | |
|---|---|---|---|
| 6237962 | 8/1994 | Japan | 36/25 R |

*Primary Examiner*—B. Dayoan

[57] ABSTRACT

A lightweight sole construction to be secured beneath a shoe for comfortable stride amplification by absorbing and releasing a user's impact energy. The invention accomplishes this by providing three primary elements which emulate, in sequence, the three basic movements of a forwardly moving foot in contact with the ground which are; heel impact, roll-over, and metatarsal thrust. A hinged leaf spring, having a pair of hinged leaves sandwiched in the heel area of a frame, absorbs energy by tensioning a group of ringed elastics as it's lower curved ends separate. An x-shaped leaf spring, being sandwiched in the toe area between a top and base plate, engages and emulates the user's metatarsal thrust by having free ends which slide apart when depressed and stretch a group of ringed elastics while pivoting about a central axis. A z-shaped platform houses and aligns the spring devices while providing a central support for the user's weight to roll-over. The device affords comfort to the user by employing spring mechanisms that inherently resist unwanted movements such as sidesway, and which are easily adjustable.

9 Claims, 11 Drawing Sheets

TRIPLE-ACTION, ADJUSTABLE, REBOUND DEVICE

FIELD OF INVENTION

This invention relates to spring action footwear and more specifically to such footwear which amplify the stride of the user.

DESCRIPTION OF PRIOR ART

It has long been known, that when people walk, jog, or run, a significant percentage of their forward kinetic energy is wasted and lost. This loss results in shock which is caused by a person's foot impacting with the ground. How to store and release this energy loss is the overall problem. Existing embodiments usually involve an assemblage of springs adhered to the base of a shoe. Generally, the higher the assemblage elevates a user's foōt above the ground, the more thrust imparted to the user. This fact leads to a problem with lateral stability. Generally, the higher a user's foot is elevated above the ground, the easier it will be for a user to twist an ankle. Coil springs are inherently unstable in a lateral direction causing unwanted sidesway, especially upon release. Devices that employ a group of coil springs arranged under a shoe generally lack adequate lateral stability and may pose a safety risk. An example of such a device is U.S. Pat. No. 4,660,299 to Omilusik (1987) which utilizes four vertically disposed coil springs adhered to the sole of a shoe. Since Omilusik mounts the four springs independently with one end free, the energy released from each can be misdirected and unsynchronized with it's neighbor.

A solution to the lateral stability problem is to add a guiding mechanism to the spring assembly. Embodiments of this type usually include two vertically spaced plates biased apart by the spring assembly. U.S. Pat. No. 4,912,859 (1989) to Ritts is an example of this type. Ritt arranges a grid of vertically disposed coil springs between two horizontal plates, elastically connecting the plates with a diagonal arrangement of broad flat cross bars. These cross bars stabilize the top plate against excessive sidesway or lateral instability while permitting vertical motion. The cross bars serve as the guiding mechanism, however, as the complexity of a device increases, so does the weight of the device. Generally, the greater the weight placed on a person's lower extremities, the less comfortable is a person's forward motion. A solution to the weight dilemma is to employ spring devices between the plates which are intrinsically, laterally stable thereby eliminating the need for an added guiding mechanism.

Many embodiments utilize a broad leaf spring to elastically connect the upper and lower plates. These constructions avoid the problems associated with coil springs and usually offer the advantage of a dual-spring action. A person's foot in natural forward motion undertakes three basic movements; a heel impact, followed by a rolling-over movement, and ending with a metatarsal thrust. Comfort to the wearer is increased when a device emulates these three natural movements in sequence. These devices attempt to emulate this natural motion. An example of this type of footwear is U.S. Pat. No. 4,534,124 (1985) by Schnell. Schnell relies on a broad leaf spring connected from the front or rear of the upper plate to the front or rear of the lower plate for primary energy storage. The diagonal leaf forms cavities in the heel and toe areas permitting alternate deflections to occur in those areas. Since this device employs only one spring to mimic the foot's three natural movements, the emulation is vague. Another disadvantage is the lack of adjustability. Because thrust is directly related to deflection, it is desirable to have a spring rate adjusted to approach maximum deflection, based on the users weight and velocity. To achieve this, the spring rates need to be adjustable. Other examples of leaf spring based footwear are; U.S. Pat. No. 4,360,978 (1982) by Simpkins, and U.S. Pat. No. 5,343,636 (1994) by Sabol.

Many other types of mechanisms have been proposed. There are devices that provide heel rebound only; such as, U.S. Pat. No. 4,894,934 (1990) by Illustrato, which confines the apparatus within a thin sole, and U.S. Pat. No. 5,282,325 (1994) by Beyl, who proposes heel rebound cartridges. U.S. Pat. No. 5,343,637 (1994) by Schindler offers a pair of heel and toe spiral leaf springs. All of these inventions lack either:

(a) sufficient deflection to provide ample thrust, (b) emulation of a person's natural foot movements, (c) lateral stability, (d) spring rate adjustability, or (e) low relative weight.

The solution to the overall problem involves the design of a unique group of components that directly correspond to the three essential elements of the foot's natural movements, while conforming to above listed specifications.

OBJECTS AND ADVANTAGES

A primary object of the present invention is to provide a spring-equipped sole construction capable of storing and releasing foot impact energy in a manner which closely resembles the natural movements of a person's foot in forward motion.

Another object is to provide a sole construction of the aforesaid nature having a stable, stride-amplifying effect.

An additional object is to provide a sole construction as in the foregoing object having user-adjustable internal spring assemblies.

A further object is to provide a lightweight sole construction that will overcome the shortcomings of the prior art devices.

A still further object is to provide a foot prosthesis of the aforesaid nature having an upper body resembling an upper foot, for pivotable attachment at the ankle area of an artificial leg.

Further objects and advantages will become apparent from a consideration of the drawings and ensuing descriptions.

Many previous embodiments employed groups of coil springs arranged under an article of footwear. Examples of this type are Omiluslk U.S. Pat. No. 4,660,299, and U.S. Pat. No. 4,457,0849. The primary problem with this type is that they permit unwanted lateral motion or sidesway. To remedy this problem, stabilizing mechanisms were added to stabilize the coils as seen in Ritt U.S. Pat. No. 4,912,859. The addition of more mechanisms unfortunately adds weight which is uncomfortable. Another large group of prior inventions utilize broad leaf springs, which are generally deployed diagonally between two horizontal plates, for primary energy storage. Examples of this type are Sabol U.S. Pat. No. 5,343,636, Simpkins U.S. Pat. No. 4,360,978, Schnell U.S. Pat. No. 4,534,124 and Whatley U.S. Pat. No. 5,060,401. Although this type provide a heel toe dual action, the emulation to a foot's three natural movements during footplant or contact with the ground is vague and uncomfortable. There are other attempts which offer various types of heel cartridges built within a sole such as Beyl U.S. Pat. No. 5,282,325, Illustrato U.S. Pat. No. 4,894,934 and Jacinto U.S. Pat. No. 4,592,153. The shortcomings with these are a general lack of thrust due to their constricted spring path or distance above the ground. Still other devices have employed groups of spiral leaf springs as seen in Schindler U.S. Pat. No. 5,343,637, or a large number of spring washers such as U.S. Pat. No. 4,267,648.

None of these stride amplifying devices accurately emulate the foot's natural movements during footplant while also offering dual adjustability, inherent lateral stability and low relative weight.

A BRIEF DESCRIPTION OF THE DRAWINGS

Reference Numerals In Drawings

| | | | |
|---|---|---|---|
| 18 | sole construction | 20 | shoe |
| 22 | z-shaped platform | 24 | tab |
| 26 | heel angled strip | 27 | hinge pin |
| 29 | arrow, central support | 30 | hinged leaf spring |
| 31 | arrow, central support 2 | 32 | ringed elastics |
| 33 | longitudinal shaft | 34 | top plate |
| 35 | heel connection | 36 | diagonal plate |
| 37 | toe connection | 38 | base plate |
| 40 | non-skid covering | 44 | guide |
| 46 | x-shaped leaf spring | 47 | angled strips |
| 48 | posterior x-spring leaf | 50 | anterior x-spring leaf |
| 52 | hinged leaf spring leaves | 53 | lower shaft |
| 54 | upper end | 55 | rounded end apertures |
| 56 | lower ends | 57 | curved end apertures |
| 58 | upper cutouts | 59 | lower cutouts |
| 62 | x-spring aperture | 63 | planar surface |
| 64 | screw studs | 66 | lobe |
| 67 | foot prosthesis | 68 | lobe aperture |

DETAILED DESCRIPTION OF THE PREFERRED EMBODIMENTS

Figure 1:
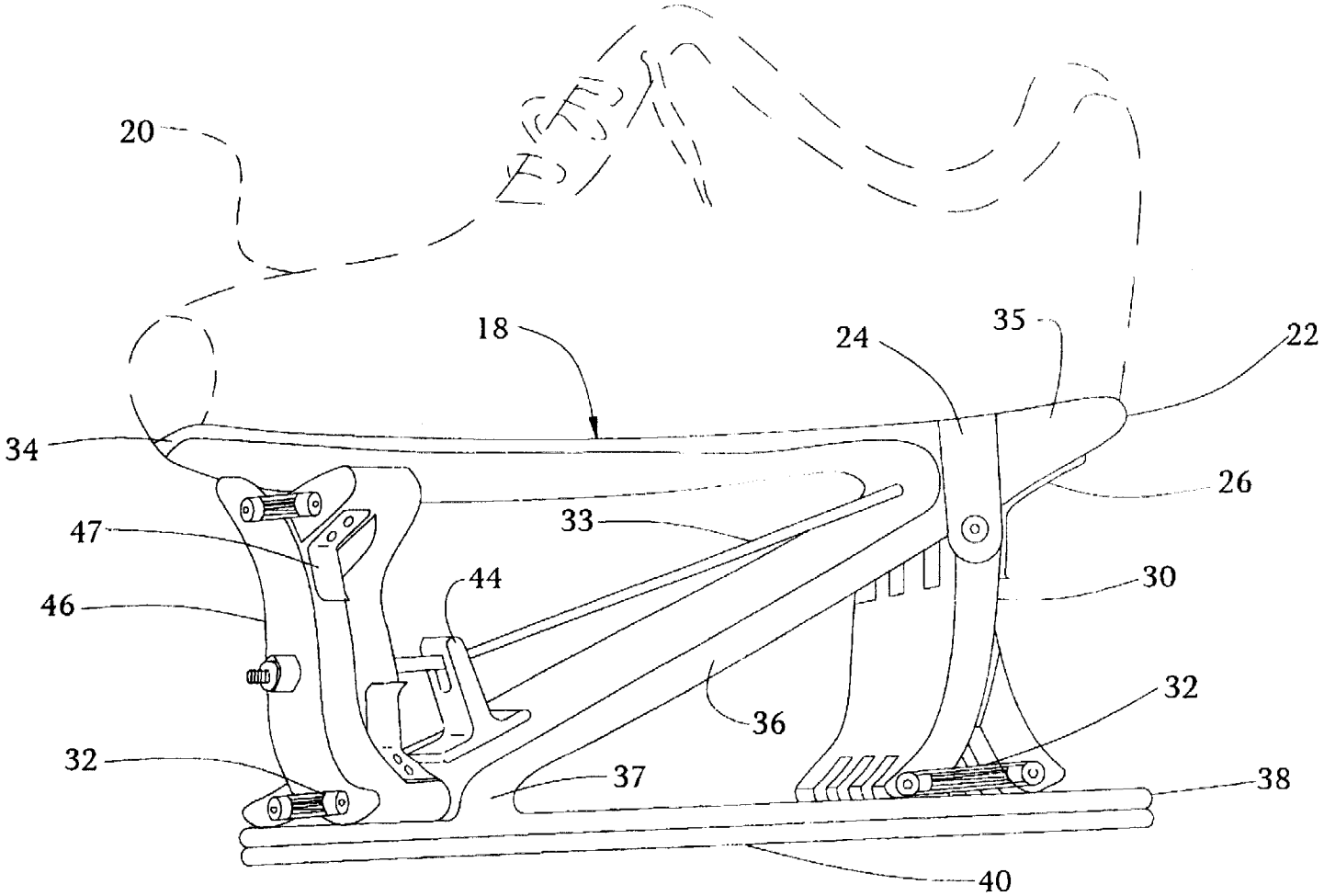
FIG. 1 shows a perspective side view of an embodiment of the invention in position beneath an article of footwear. The often referred to longitudinal direction extends from the user's heel to toe, and the lateral direction extends from the user's right to left side.

Referring now to the drawings and to FIG. 1 in particular, there is shown a sole construction 18 built in accordance with the invention, which is designed to be mounted on the base of a shoe 20. The sole construction 18 is comprised of a z-shaped platform 22, having a toe and heel area corresponding respectively, with a toe and heel area of the shoe. The platform is fabricated of lightweight, semi-flexible, resilient, material such as nylon, or the like, having a longitudinal cross sectional area resembling the letter z. The lateral direction extends from the user's right to left side, and the longitudinal direction extends from the user's heel to toe. The z-shaped frame is further comprised of a horizontally disposed top plate 34, spaced parallel to a base plate 38, and a coplanar diagonal plate 36. The top plate 34, whose outline resembles the sole of a shoe, is integrally connected, in the heel area, to the diagonal plate 36 forming a heel connection 35. The diagonal plate 36 extends downward toward the toe area where it is integrally connected to the base plate 38 forming a toe connection 37. These connections are spaced a distance from the longitudinal ends such that the heel area connection is laterally centered under the calcaneus or heel bone of a user, and the toe area connection is laterally centered under the metatarsals or forward foot bones of the user. The length and width of the platform being generally equivalent, respectively, to the length and width of the shoe. The height of the sole construction, as measured vertically from the base plate 38 to the top plate 34 inclusive, is generally equal to the width of the shoe. The lower surface of the base plate 38 is covered with a non-skid material 40 for improved adherence with the ground.

Figure 2:
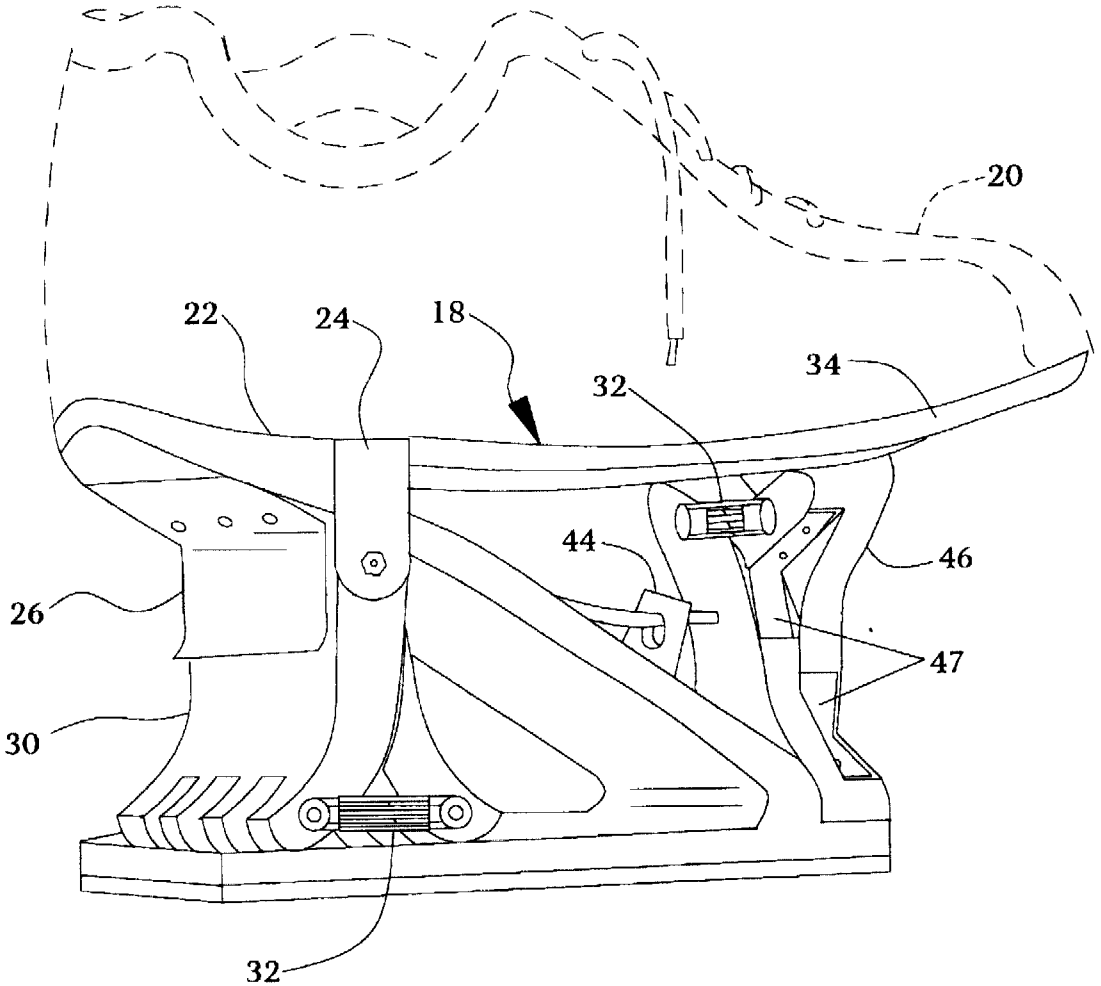
FIG. 2 shows a perspective rear view of an embodiment of the invention in position beneath an article of footwear.
Figure 3:
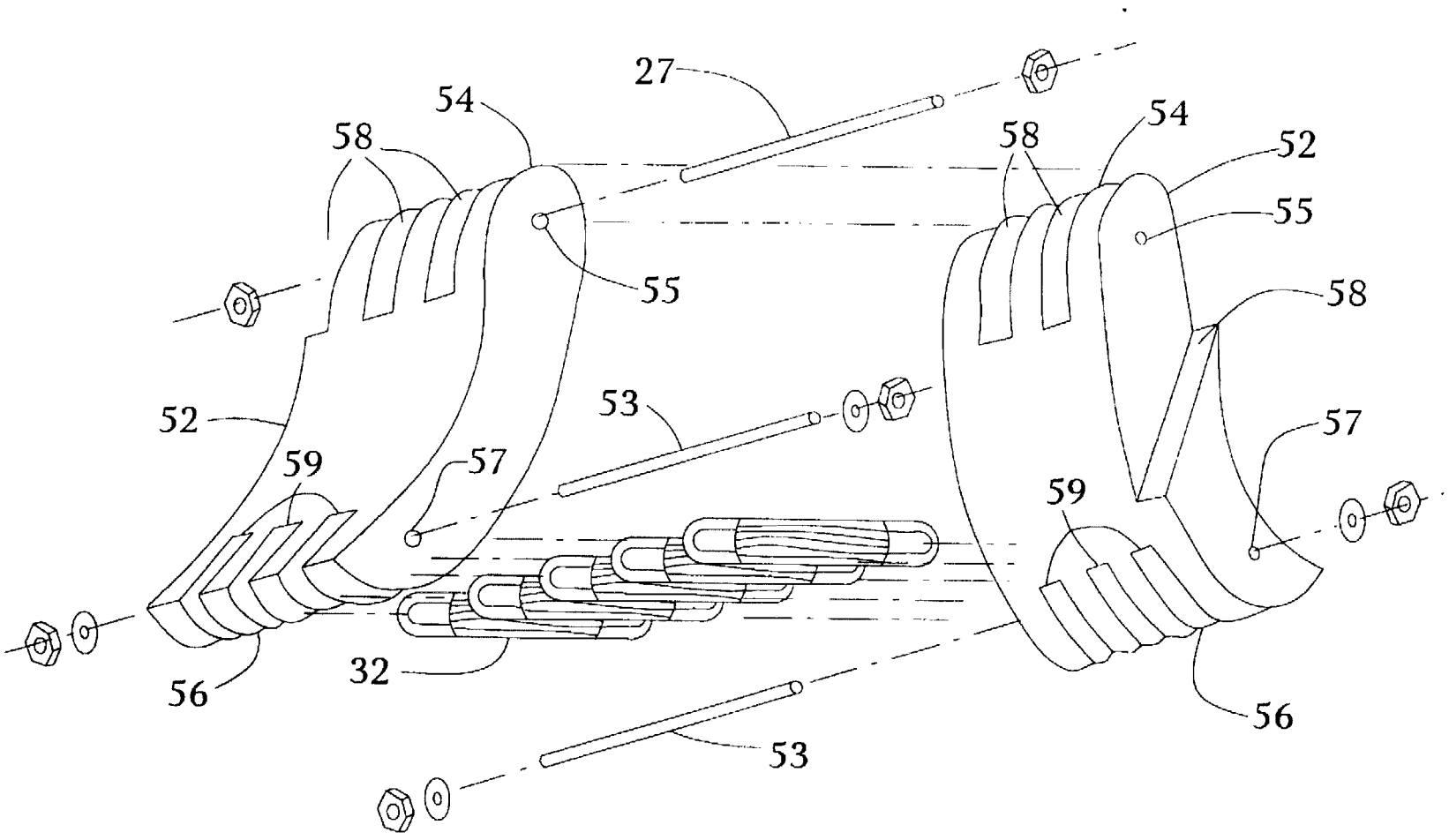
FIG. 3 shows an exploded view of the hinged leaf spring 30.

A hinged leaf spring 30 is positioned contiguously under, and parallel to, the heel connection of the z-shaped frame 22 as shown in FIG. 2. The hinged spring 30 is comprised of two rectangular, planar leaves 52 fabricated of a lightweight, rigid material, such as nylon. These leaves 52 are vertically oriented with upper ends 54 being rounded and lower ends 56 being outwardly curved as shown FIG. 3. The upper ends 54 also have alternate, interlocking cutouts 58 and an aperture 55 centered within the rounded end and extending laterally through each leaf. A hinge pin 27 extends through the aperture 55 and is pivotably secured by two tabs 24 which extend below the heel connection. The hinge pin 27 pivotably secures the upper ends 54 under the heel connection in the manner of a hinge. An angled strip 26 of resilient material such as spring steel, is juxtaposed contiguously to the upper ends 54. The angled strip 26 has a fixed end secured under the top plate 34 and a free end slidably engaged with the leaves. The lower ends 56 have opposing cutouts 59 and apertures 57 extending through laterally. A pair of shafts 53 extend through the apertures 56 and pivotably engage an outer ring of a group of ringed elastics 32. The ringed elastics 32 are comprised of three chain links with the outer links being rigid, and the inner link comprising a group of endless elastic bands.

Figure 7:
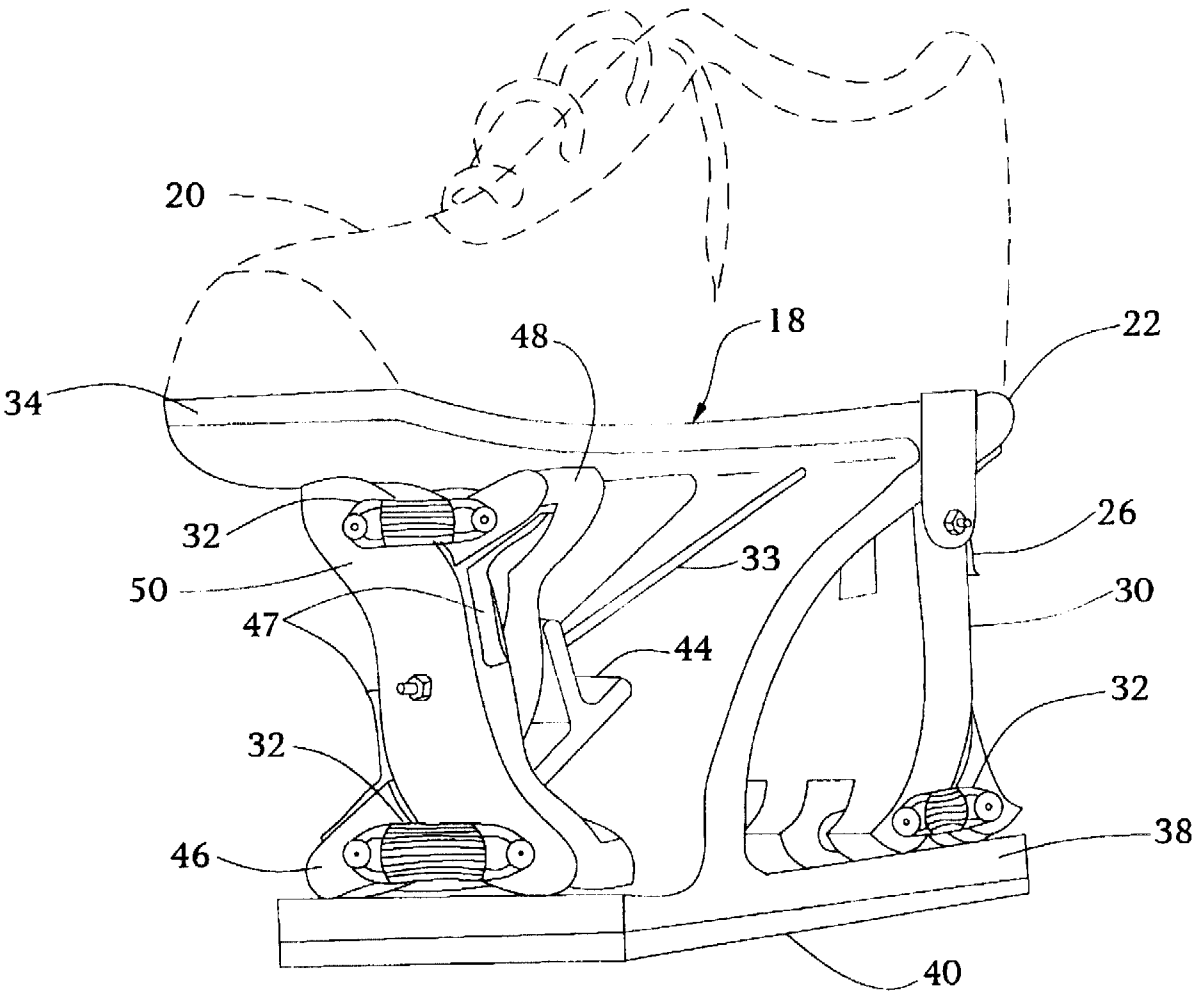
FIG. 7 shows a perspective front view of an embodiment of the invention in position beneath an article of footwear.
Figure 8:
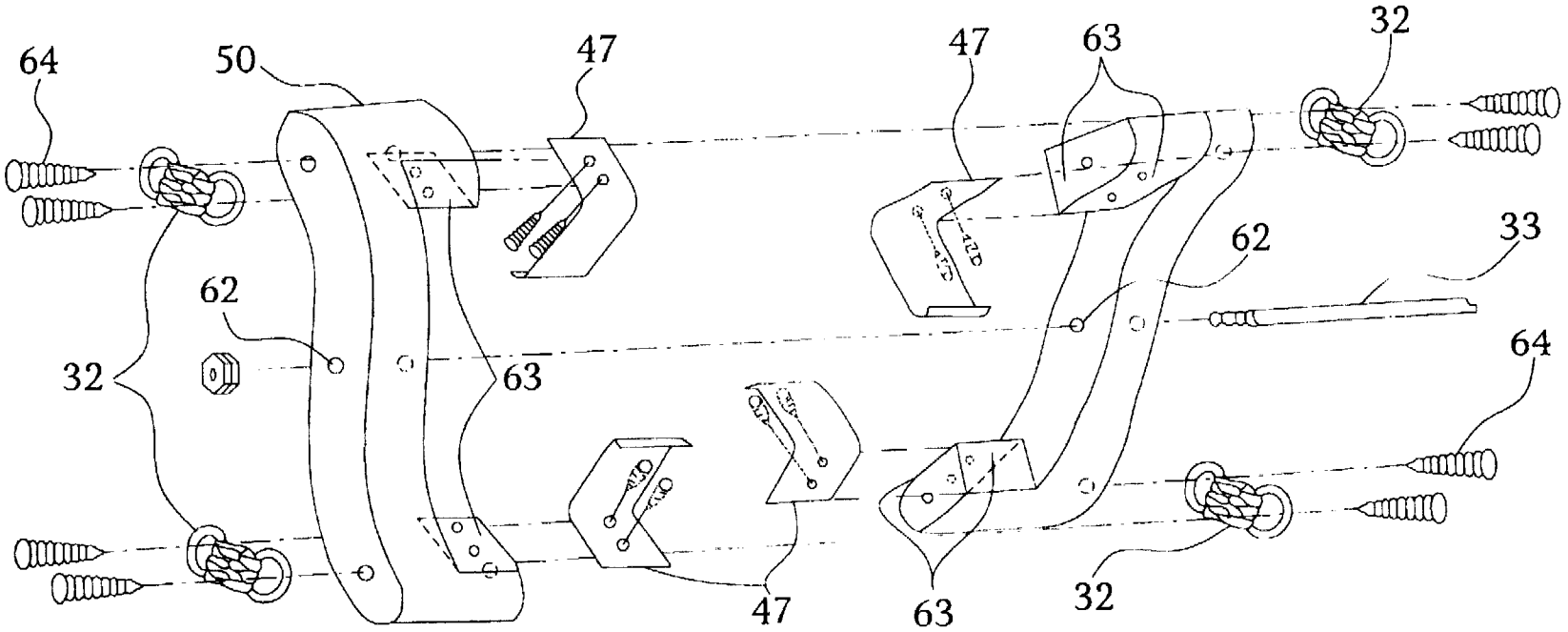
FIG. 8 shows an exploded view of the x-shaped leaf spring 46.

An x-shaped leaf spring 46 having a lateral cross sectional area resembling the letter x, is sandwiched between the top plate 34 and the baseplate 38. The spring 46 is positioned such that its x-shaped cross section extends laterally across the toe area of the platform 22 as shown in FIG. 7. The x-shaped spring 46 is comprised of two s-shaped, interlocking leaves 48, 50, each having curved outer ends which are slidably engaged with the inner sides of the top plate 34 and the base plate 38. The leaves have a vertically centered aperture 62 located at the inflection point of their s-shape as illustrated in FIG. 8. A shaft 33 emerges longitudinally from a central location of the heel connection 35 and pivotably secures the leaves 48, 50 by extending through the aperture 62. The shaft 33 extends through a slotted guide 44 which restricts lateral movement of the spring assembly 46. Concentric to the aperture 62, the leaves have opposing, central area, notches extending a distance equaling one half their longitudinal depth. The notches extend toward the curved ends and taper to points. The points being separated by generally perpendicular planar surfaces 63 which project out, in a longitudinal direction, causing the leaves to interlock. Angled strips of resilient material 47, such as spring steel, have a fixed end secured to a generally horizontal planar surface of a leaf and a free end slidably engaged with a generally vertical surface of an adjacent leaf. The curved ends fixedly secure screw studs 64 in a central location on their longitudinal surfaces. The studs 64 pivotably secure a group of ringed elastics 32. The elastics 32 are apositioned in horizontal pairs on the upper curved ends and the lower curved ends. These elastics 32 are similarly constructed as the ringed elastics 32 of the hinged leaf spring 30, only sized to fit the minimum horizontal distance separating each pair of studs 64.

Figure 11:
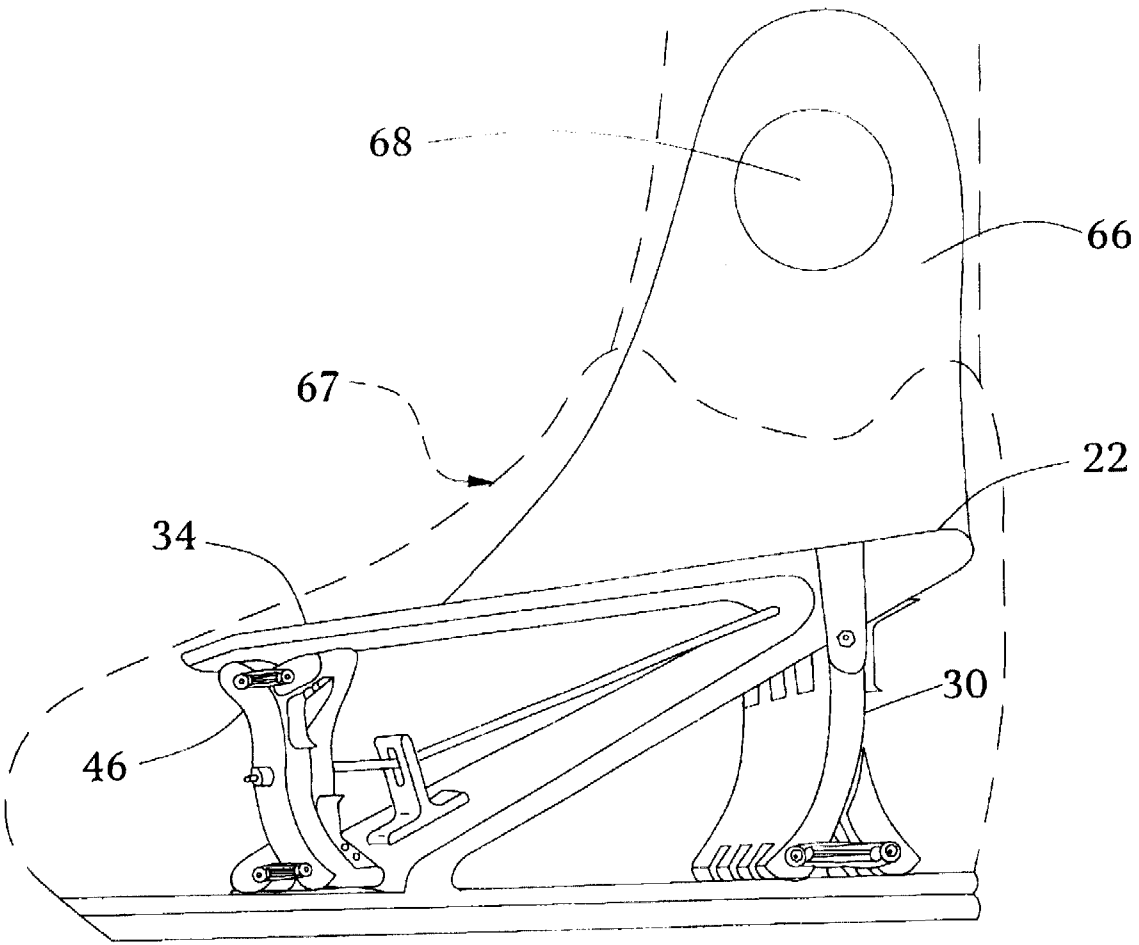
FIG. 11 shows a perspective side view of a second embodiment of the invention attached to the base of an artificial leg.

A second embodiment 67 of the invention is disclosed in which the top plate 34 inclines downward toward the toe area of the platform 22 as shown in FIG. 11 such that the sole construction 18 fits within the outer covering of a shoe. A lobe 66 of lightweight, rigid, material, having a lower planar surface, is fixedly secured to the upper surface of the top plate 34. The lobe 66 is shaped to resemble, in combination, a portion of an upper foot and a lower ankle. The lobe 66 has a tapered upper end which contains a lateral aperture 68. The aperture 68 provides access for an axle to pivotably connect the foot prothesis 67 to the lower end of a user's artificial leg.

Figure 4:
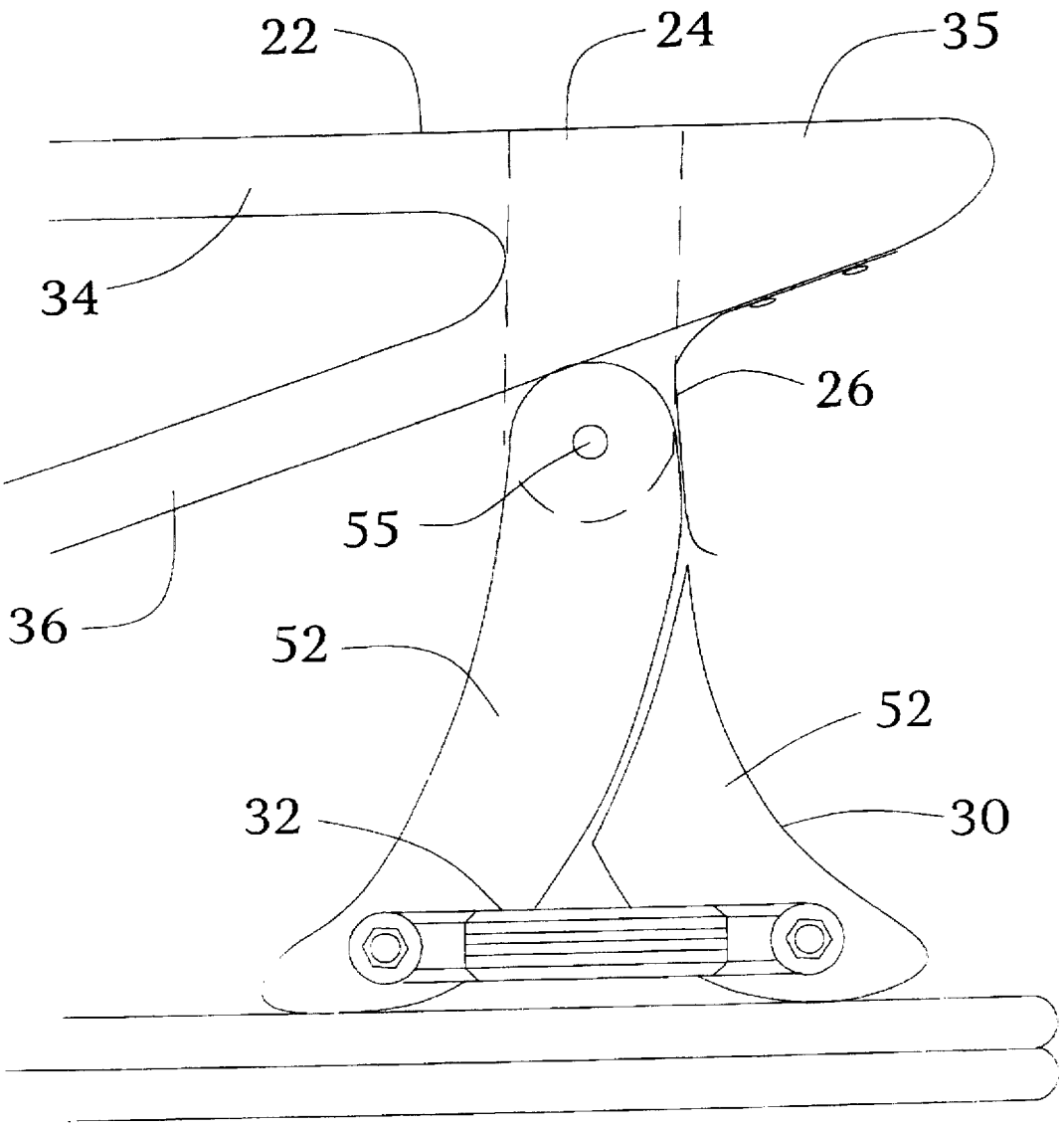
FIG. 4 shows a side elevation of the hinged leaf spring 30 in an uncompressed state.
Figure 5:
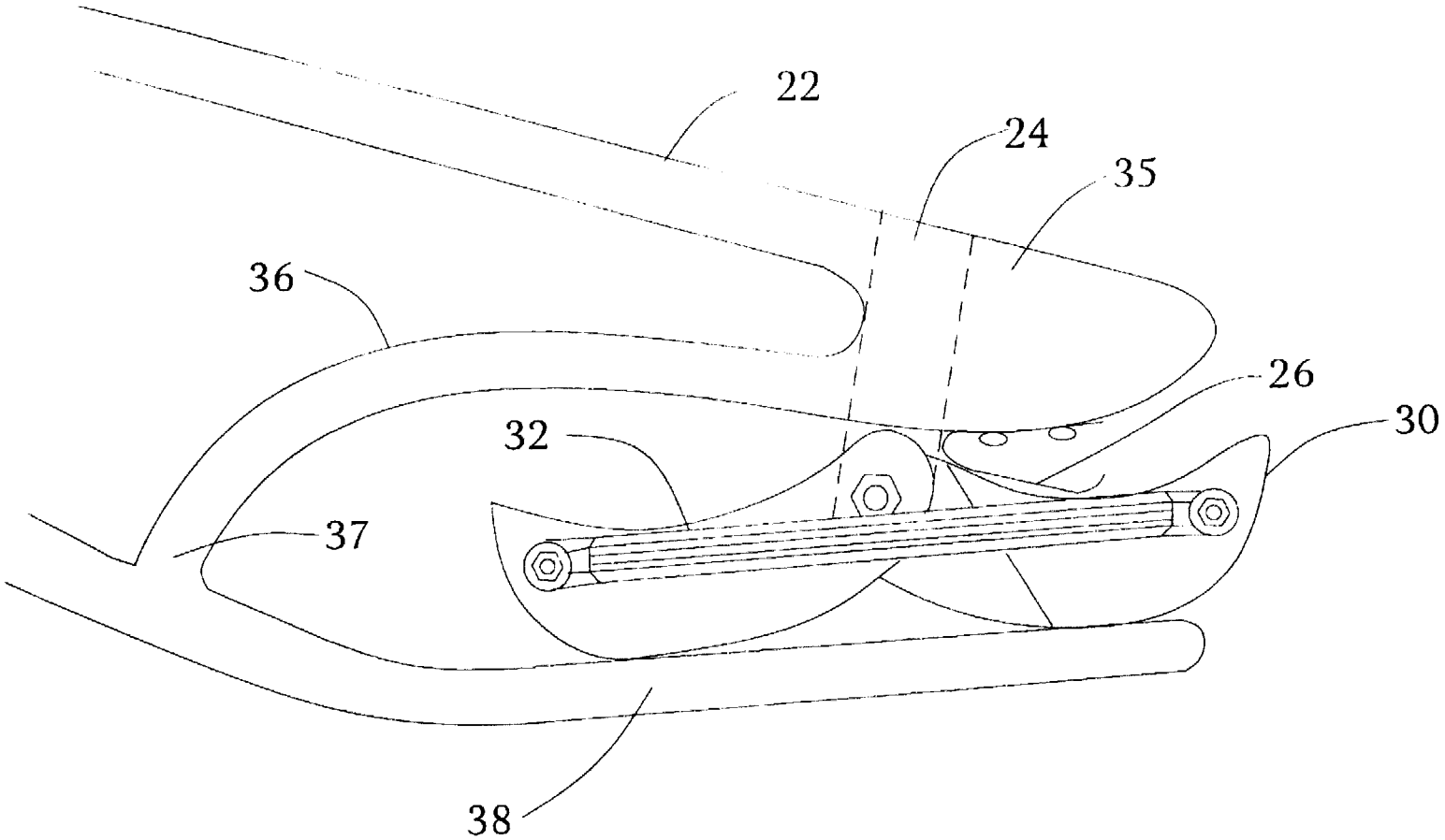
FIG. 5 shows a side elevation of the hinged leaf spring 30 in a fully compressed state.

The sole construction 18 is comprised of three main elements; a heel mechanism or a hinged leaf spring 20, a frame or z-shaped platform 22, and a front mechanism or an x-shaped leaf spring 46. In use, these three elements relate directly to the three basic movements of a user's foot in forward motion which are; heel impact, roll-over, and metatarsal thrust. Roll-over is a pendulum-like movement which occurs as a person's weight seesaws from the heel area to the metatarsal area of the foot. As the user enters a stride, the heel's impact with the ground causes a downward force which urges the lower ends of the hinged leaf spring 30 to slide in opposite directions on the upper surface of the base plate 38 and tension the resilient, elastic material in the ringed elastics 32 as shown in FIGS. 4 and 5. As the lower ends of spring 30 separate, the upper ends rotate in opposite directions around hinge pin 27 and rotate the free end of angled strip 26 toward it's fixed end, thereby absorbing energy. The hinge pin 27 restricts the leaves to longitudinal, vertical movement only, and eliminates the possibility of unwanted sidesway or lateral instability in the heel area.

Figure 6:
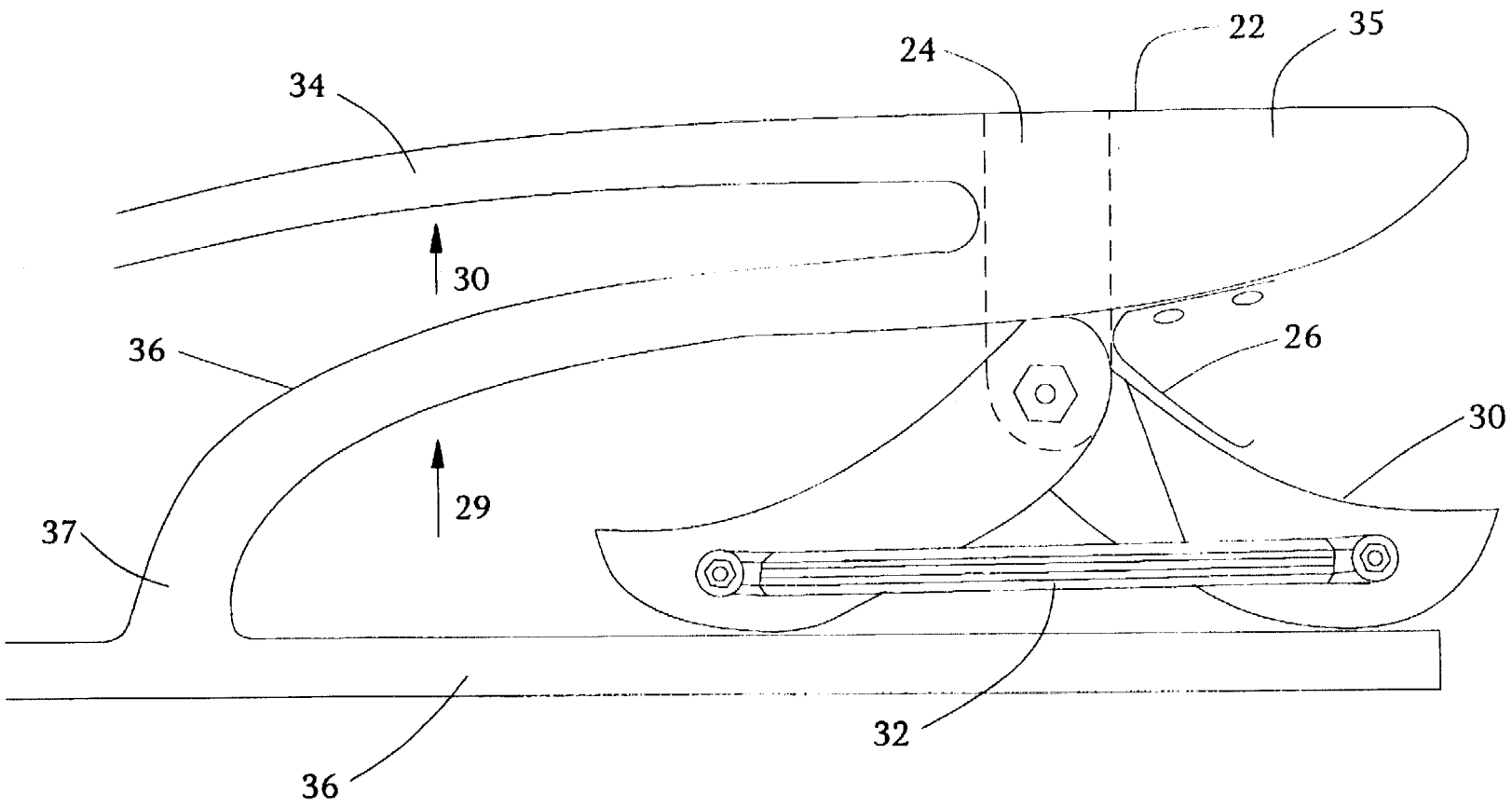
FIG. 6 shows a side elevation of the hinged leaf spring 30 at the onset of the roll-over phase with arrows 29, 31 depicting the area of central support.

The z-shaped frame 22 serves to precisely position the heel mechanism 30 under the heel of the user, and the front mechanism 46 under the metatarsals as shown in FIG. 1. The platform 22 also provides the central vertical support for roll-over to occur over, by acting as a double cantilever beam. The first cantilever is the diagonal plate 36, which has a fixed end at the toe connection 37 and a free end at the upper heel connection 35. The second cantilever is the top plate 34, which has a fixed end at the heel connection 35 and a free end at the toe end. Since resistance in a cantilever beam gradually increases toward the fixed end, an upwardly resisting force occurs at the midpoint of each cantilever as illustrated by arrows 29, 31 of FIG. 6. This upward resisting force provides the support which engages, and transmits to the ground, the user's natural roll-over movement.

Figure 9:
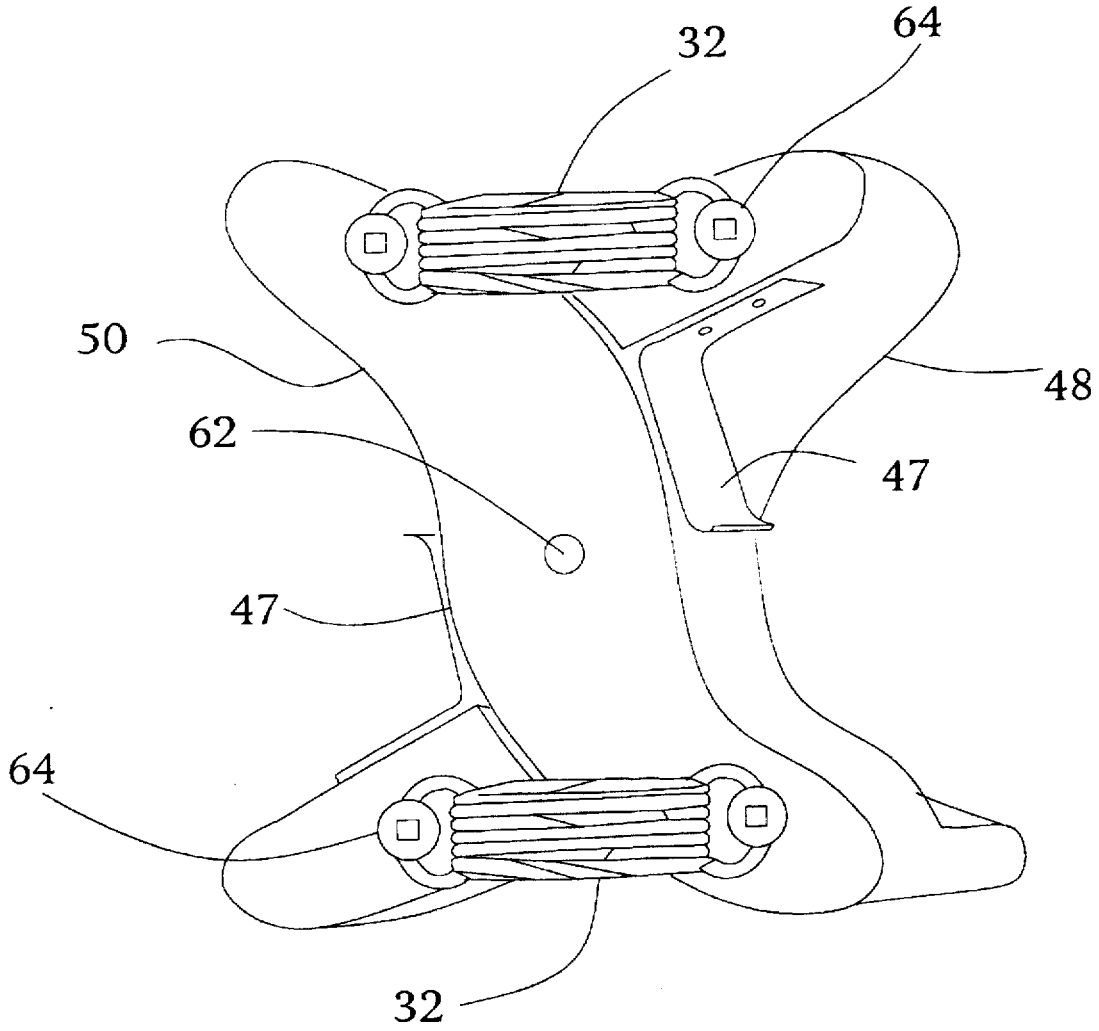
FIG. 9 shows a perspective front view of the x-shaped leaf spring 46 in an uncompressed state.

The front mechanism, or x-spring 46 relates directly to the metatarsal thrust of a person's natural forward footplant movements. After heel impact, the user's weight rolls-over, or shifts forward and simultaneously releases the heel spring 30 as the weight is removed. During this release, the lower curved ends snap-back together and the angled strip 26 is also discharged, thereby providing thrust to the user as shown in FIG. 4, 5. Towards the latter part of the curved end's snap-back, and towards the latter phase of the roll-over, the front x-spring 46 is quickly depressed and released, adding thrust as shown in FIG. 9, 10. The downward force of weight and momentum sandwiches the outer curved ends of the x spring 46 between the inner surfaces of the top plate 34 and the base plate 38. The outer ends slide apart as the leaves 48, 50 rotate in opposite directions around the shaft 33. As the outer ends separate, the elastic inner link of the ringed elastics 32 is stretched apart and the angled strips are rotated closed. When the weight is released, the outer ends snap-back, the angled strips are released, and thrust is added to the user. Since the leaves 48,50, are s-shaped and pivotably secured at their inflection point, as the right lateral side descends, so does the left lateral side, thereby precluding independent sidesway or lateral instability. As the outer ends separate, the distance between their balance points increase, and lateral stability also increases.

Adjustability is affected by exchanging the ringed elastics in the front 46 and rear 30 mechanism. The hinged leaf spring 30 is rotated rearward, the lower shafts 53 are pulled and a different set of ringed elastics 32 are rethreaded on shafts 53. The front elastics 32 are simply pulled off the screw studs 64 and exchanged. The rigid, outer chain links of the ringed elastic assembly 32 are comprised of coils of spring steel, similiar to a key ring, where an end can be pryed apart and a certain quantity of elastic bands can be inserted within the coils, thereby permitting the user to simply and quickly adjust the spring rates by varying the quantity of elastics.

The theory of operation assumes that a person in forward motion, first lands on the heel, then rolls his or her weight over a midpoint, and concludes with a metatarsal thrust. It is further assumed that a device designed to amplify the stride must directly emulate these three basic movements in order to provide comfort to the user. It is still farther assumed that forward kenetic energy is lost, in the form shock, during heel impact. The theory predicts that a device can be built that provides comfort and stride amplification to the user if it is comprised of energy storage mechanisms and a supporting structure which closely relate to the above stated basic natural movements. Additional requirements for lateral stability, low relative weight, and adjustability are implied in the basic need for comfort.

The sole construction 18 is designed to meet the specifications required by the theory. The hinged leaf spring 30, acting in combination with the angled strip 26, closely relates to, a person's natural heel impact and also stores all the heel impact energy which may be as high as three times the user's weight. When the weight is rolled over, the stored energy is released in the form of thrust. The thrust is partially dependent on the rate of snap-back of the hinged spring 30, therefore it is advantageous to choose an elastic material with the highest rate of snap-back or resiliency. The thickness of the angled strip 26 determines it's energy absorption ability and is sized by the user's weight class. The user can adjust the spring rate of the hinged spring 30 by varying the quantity of elastics in the center link of the ringed elastics 32. In order to maximize thrust, the deflection should be gaged to closely approach it's maximum during use, based on the user's weight and anticipated rate of forward motion, such as a walk, jog, or run. The heel mechanism 30, having it's upper ends pin connected in a lateral direction to the frame 22, precludes unwanted lateral motion or sidesway, and restricts the movement to longitudinal axial motion only. It is also advantageous to use construction materials having the lowest weight to strength ratios along with the desired flexibility per component.

The z-shaped platform 22 as shown in FIG. 1 provides the supporting structure which houses and precisely aligns the energy storage mechanisms. Although the frame 22 is comprised of flexible and resilient material, it does not serve to store and release a significant quantity of energy. The frame's double cantilever arrangement allows significant deflection to occur in the heel and toe areas, but supports the user's weight in a central area, dining the roll-over phase. The diagonal plate 36 acts as the first cantilever beam with a fixed end at the toe connection 37, and the top plate 34 acts as the second cantilever with a fixed end at the heel connection 35. These cantilever beams provide upward resistance across a lateral midsection, which serves, in effect, as a central, lateral, support for the user's weight to seesaw across. The z-shaped frame 22 closely relates to, and transmits to the ground, a person's natural roll-over movement.

Figure 10:
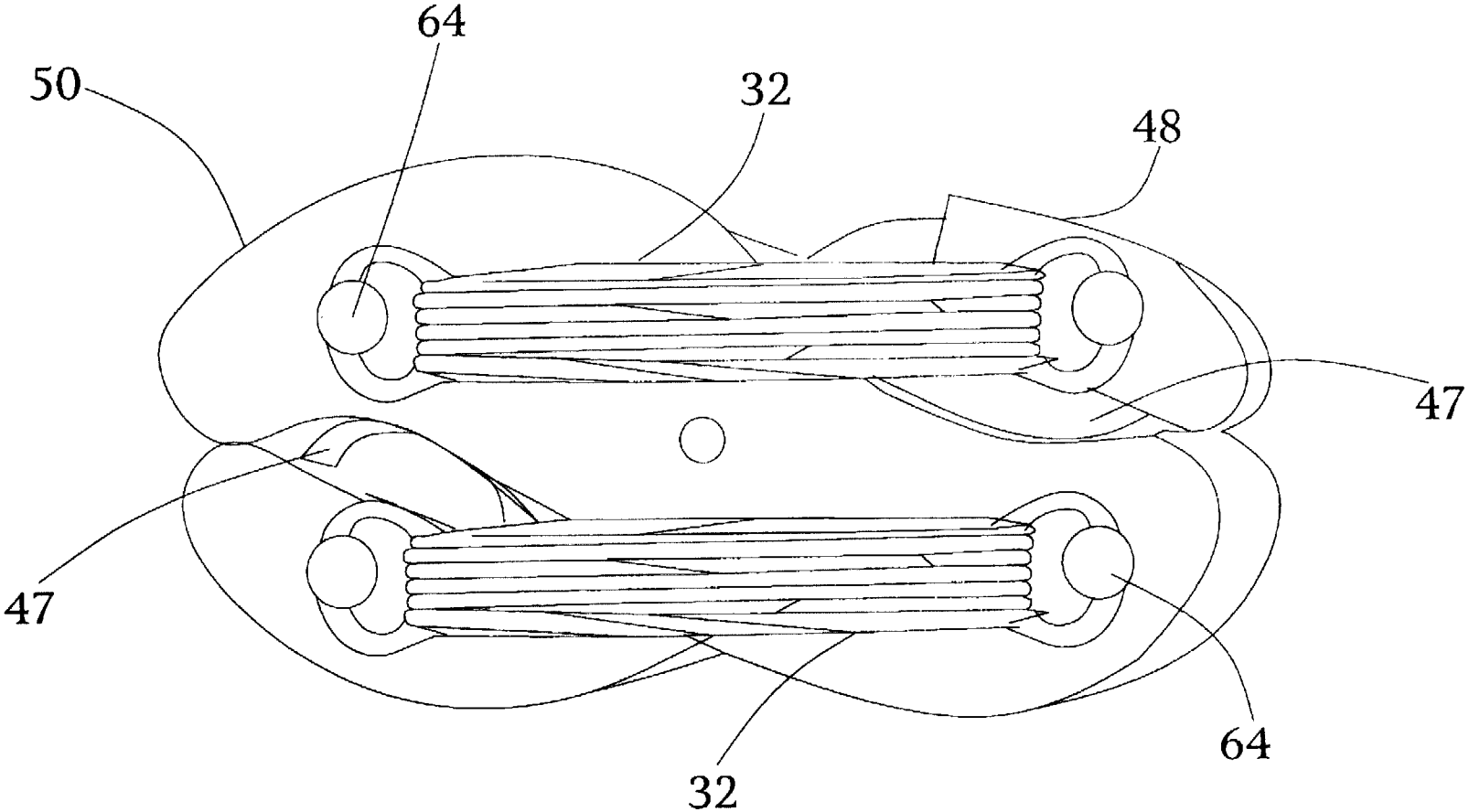
FIG. 10 shows a perspective front view of the x-shaped leaf spring in a fully compressed state.

As the rear assembly 30, 26 is providing thrust, and towards the latter part of the roll-over phase, the x-spring assembly 46 engages the user's metatarsal thrust. This occurs toward the end of footplant and is a quick action, which, upon release, adds thrust. Lateral stability is inherently derived due to the s-shape of the leaves 48, 50 and their pin connection at their inflection point as shown in FIG. 9, 10. When the spring 46 is depressed, an upper curved end of a leaf separates from it's neighbor, the diagonal lower curved end, being the lower half of the same s-shaped leaf, must also separate from its neighbor due to the pinned connection at 62, which, thereby, precludes independent lateral movement. Indeed, as the curved ends separate, stability increases because the distance between the balance points also increases. Adjustability is affected by varying the quantity of elastics in the tinged elastics 32 and by varying the thickness of the angled strips 47. The angled strips 47, 26 also serve as stops against excessive deflection as shown in FIGS. 5, 10. Since their radii are essentially incompressible, the angled strips provide a hardening spring rate toward the state of maximum deflection.

A still further assumption is that a person, in forward motion, will tend to maintain a constant velocity. This would infer that a device such as the sole construction 18 would undergo a regular, cyclic, pattern of spring compressions and expansions. This regular cycle of spring actions constitute a forcing frequency. The sole construction 18 tends to have a predominant natural frequency which lies within the range of possible forcing frequencies. When the forcing frequency equals the natural frequency resonance occurs which results in an amplification factor or a zone of enhanced effect. It is advantageous for the user to attain this zone by adjusting the various spring rates.

Accordingly, the reader will see that the sole construction 18 of this invention can provide stride amplification to the user in a comfortable and safe manner;

by emulating a person's natural foot movements, by providing adjustable spring mechanisms, by being inherently laterally stable, and by having low relative weight.

Although the description above contains many specificities, these should not be construed as limiting the scope of the invention but as merely providing illustrations of some of the presently preferred embodiments of this invention. For example, the longitudinal shaft 33 can emerge from the guide 44 rather than the heel connection 35.

Thus the scope of the invention should be determined by the appended claims and their legal equivalents, rather than by the examples given.

What is claimed is:

1. A spring-action sole construction comprising:

(a) a generally z-shaped platform of lightweight, and resiliently deformable material upon which a user's foot rests, said platform having a top plate spaced generally parallel above a base plate, both plates having a toe and heel end respectively at a toe and heel end of a shoe, and both plates having an upper and a lower surface, a diagonal plate extending downward from said heel end of said upper plate to said toe end of said base plate, said diagonal plate being laterally planar to the top and the base plates, said diagonal plate having an integral heel connection at said heel end of said top plate, said heel connection being centered laterally under a calcaneus of said user, said diagonal plate having an integral toe connection at said toe end of said bottom plate, said toe connection being positioned a predetermined distance from said toe end of said bottom plate, said platform having a length and width generally equal to a length and a width of said shoe, and said platform having a height generally equal to said width;

(b) a hinged leaf spring sandwiched between said heel ends of said top plate and said base plate, said spring comprising a pair of leaves, said leaves being generally rectangularly planar, both leaves having an upper end, said upper ends being pivotably secured contiguous to said heel connection and parallel thereto, said upper ends being longitudinally rounded, said ends having alternate, interlocking crenelations, and said ends having a centered aperture, said aperture pivotably secures a hinge pin, said pin axially engages said upper ends, said leaves having outwardly curved lower ends, said curved ends having opposing crenelations, said curved ends, each having an aperture extending laterally, said aperture pivotably secures a shaft, said shafts, acting in combination, pivotably secure outer links of a plurality of ringed elastics, said ringed elastics comprising an open ended chain of three links, the outer links being rigid, and a middle link being comprised of a plurality of endless, elastic belts;

(c) an x-shaped leaf spring having a lateral cross sectional area resembling the letter x, is sandwiched laterally between said toe ends of said top and said base plate, said x-shaped spring having two s-shaped, interlocking leaves, said leaves having upper and lower ends, said lower ends being slidably engaged within heretofore said predetermined distance, said upper ends being slidably engaged, in a lateral direction, to said under surface of said top plate on a line generally centered laterally under said user's metatarsal foot bones, both leaves having a vertically centered aperture extending through longitudinally at an inflection point, said aperture pivotably secures a shaft, said shaft emergent longitudinally from said platform, said shaft having a free end, said free end being laterally secured by a guide, said free end being mounted to said x-shaped spring, said leaves have opposing, interlocking cutouts concentric to said aperture, said cutouts extend outwards toward said curved ends, said cutouts having a plurality of planar surfaces towards said curved ends, said curved ends fixedly secure a plurality of screw studs, said studs being horizontally disposed on a plurality of longitudinal surfaces of said curved ends, and said studs pivotably engage the rigid outer links of a plurality of heretofore said ringed elastics, whereby (d) said lower ends of said hinged leaf spring and said curved ends of said x-shaped leaf spring sequentially separate and contract in a rocking motion across a central support structure in response to forces urged by the user, absorbing the forces of impact and imparting thrust to the user.

2. A spring-action sole construction as set forth in claim 1, including an angled strip of resilient elastic material, comprised of spring steel, having a fixed end secured to said lower surface of the heel end of said top plate, and said strip having a free end contiguous to said upper end of said leaves; wherein said free end of said strip slidably rotates toward said fixed end as said leaves separate, storing and releasing energy as said hinged leaf spring is compressed and released.

3. A spring-action sole construction as set forth in claim 2, including a plurality of small angled strips of resilient elastic material, comprised of spring steel, said small strips having a fixed end secured to a heretofore said planar surface of said x-shaped leaf spring, said strips having free ends adjacent to a central, lateral, surface of a rotationally opposing leaf, such that said free ends of said small strips slidably engage the opposing leaf while rotating towards their fixed ends, storing and releasing energy as the x-spring is compressed and released.

4. A spring-action sole construction as set forth in claim 3, wherein a wear resistant material is fixedly adhered to said lower surface of said base plate whereby the user's tractional contact with a ground surface is enhanced.

5. A spring-action sole construction as set forth in claim 3 wherein; said top plate slopes downward toward the toe area of said base plate in a manner spaced to fit within the outer coverings of a shoe, said upper surface of said upper plate being fixedly secured to a lower planar surface of a body, said body having a shape similar to a person's combined upper foot and lower ankle, said body tapering to an upper lobe end, said upper lobe end having a lateral aperture, whereby said aperture in said upper lobe pivotably secures said body to a base of a user's leg, providing a natural emulation of a forwardly moving foot.

6. A rebound footwear device for a shoe which comprises:

a) a resilient, semi-flexible, z-shaped platform having a top and base plate spaced approximately horizontal and parallel, said plates having a toe and heel end, said heel end of said top plate being integrally connected to said base plate by a coplanar diagonal plate forming a heel connection and a toe connection, said diagonal plate being recessed a predetermined distance from said ends forming a toe area and a heel area, said heel connection being centered, laterally under the user's heel or calcaneous bone, said areas providing deflection space for a heel spring means and a metatarsal spring means, said upper plate and diagonal plate, being cantilever beams, provide a central, structural support for the spring means to seesaw across, b) said heel spring means comprising, a pair of rectangular, planar leaves having crenelated, rounded, bored, upper ends which are rotationally interlocked by a hinge pin forming a hinge pin connection, said pin connection being contiguously positioned under said heel connection, said planar leaves having outwardly curved lower ends slidably engaged with an upper surface of said base plate, said lower ends having opposing, crenelations, said crenelations having laterally extending apertures, said apertures containing a plurality of shafts, said shafts thread an outer link of a plurality of ringed elastics, said ringed elastics being comprised of an open ended chain of three links, the outer links being rigid, the inner link being comprised of a plurality of endless elastic bands such that said lower ends separate when urged by a vertically applied force and stretch said endless elastic bands absorbing and releasing energy to the user, c) said metatarsal spring means sandwiched between said top and base plates in said toe area, said spring having a pair of interlocking, s-shaped leaves, said leaves having outer curved ends slidably engaged between said top and base plates, both leaves having a vertically centered aperture extending through longitudinally, said aperture containing a shaft, said shaft having a free end which pivotably secures said leaves, said leaves having opposing cutouts concentric to said aperture providing interlocking rotation about said shaft, said cutouts flaring outwards toward said curved ends forming pairs of generally perpendicular planar surfaces, said curved ends fixedly securing a plurality of screw studs on their longitudinal surfaces, said studs pivotably secure an outer link of a plurality of heretofore said ringed elastics, such that said s-shaped leaves separate when urged by a vertical force causing said ringed elastics to be tensioned and thereby providing an energy storage means.

7. A rebound footwear device as set forth in claim 6, including at least one angled strip of resilient elastic material comprised of spring steel, having a fixed end secured to a lower surface of said heel area of said top plate, and said strip having a free end adjacent and contiguous to said upper end of said leaves, wherein said free end of said strip slidably rotates toward said fixed end as said leaves separate, storing and releasing energy as said heel spring means is compressed and released.

8. A rebound footwear device as set forth in claim 7, including a plurality of small angled strips of resilient elastic material, comprised of spring steel, said small strips having a fixed end secured to heretofore said planar surface of said metatarsal spring means, said strips having free ends adjacent to a central, lateral, surface of a rotationally opposing leaf, such that said free ends of said small strips slidably engage the opposing leaf while rotating towards their fixed ends, storing and releasing energy as the metatarsal spring is compressed and released.

9. A rebound footwear device as set forth in claim 8 wherein a wear resistant material is fixedly adhered to said lower surface of said base plate whereby the user's tractional contact with a ground surface is enhanced.

* * * * *